US011011831B2

(12) United States Patent
Hashimoto et al.

(10) Patent No.: US 11,011,831 B2
(45) Date of Patent: May 18, 2021

(54) DIRECTIONAL ANTENNA

(71) Applicant: YAMAHA HATSUDOKI KABUSHIKI KAISHA, Iwata (JP)

(72) Inventors: Yasushi Hashimoto, Iwata (JP); Yoshihiko Kuwahara, Hamamatsu (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 0 days.

(21) Appl. No.: 16/256,135

(22) Filed: Jan. 24, 2019

(65) Prior Publication Data

US 2019/0229409 A1 Jul. 25, 2019

(30) Foreign Application Priority Data

Jan. 24, 2018 (JP) ..... JP2018-009364

(51) Int. Cl.
*H01Q 1/32* (2006.01)
*H01Q 9/04* (2006.01)
(Continued)

(52) U.S. Cl.
CPC ..... *H01Q 1/32* (2013.01); *H01Q 1/48* (2013.01); *H01Q 9/0407* (2013.01);
(Continued)

(58) Field of Classification Search
None
See application file for complete search history.

(56) References Cited

U.S. PATENT DOCUMENTS 7,202,824 B1 * 4/2007 Sanelli ..... H01Q 1/523 343/702
10,431,875 B2 * 10/2019 Chang ..... H01Q 5/385
(Continued)

FOREIGN PATENT DOCUMENTS

EP 2965979 A1 1/2016
JP H02113706 A 4/1990

OTHER PUBLICATIONS

Misao Haneishi et al., "Small Planar Antenna", The Institute of Electronics, Information and Communication Engineers, Aug. 1996, p. 177-181.

(Continued)

*Primary Examiner* — Seokjin Kim
(74) *Attorney, Agent, or Firm* — Rabin & Berdo, P.C.

(57) ABSTRACT

A directional antenna includes a substrate, a power-supply radiating element, paired non-power-supply radiating elements, and a metal plate. The power-supply radiating element is formed on the front surface of the substrate to be along the vertical direction. The power-supply radiating element receives electric power from the power-supplying portion. The paired non-power-supply radiating elements are provided along the vertical direction and oppose each other across the power-supply radiating element in a horizontal direction which is a direction along the front surface of the substrate on the horizontal plane, when viewed in a front-rear direction. A part of the metal plate is provided behind a part of the power-supply radiating element. The metal plate is not provided behind the paired non-power-supply radiating elements. The 3 dB beam width of the directional antenna on the horizontal plane is equal to or greater than 180 degrees including the range forward of the directional antenna.

8 Claims, 3 Drawing Sheets

(51) Int. Cl.
*H01Q 9/28* (2006.01)
*H01Q 19/00* (2006.01)
*H01Q 1/48* (2006.01)
*H01Q 21/29* (2006.01)

(52) U.S. Cl.
CPC ..... *H01Q 9/285* (2013.01); *H01Q 19/005* (2013.01); *H01Q 21/29* (2013.01); *H01Q 1/325* (2013.01)

(56) References Cited

U.S. PATENT DOCUMENTS

2006/0232492 A1* 10/2006 Sawatani ..... H01Q 1/242 343/893
2008/0088510 A1* 4/2008 Murata ..... H01Q 19/28 343/700 MS
2009/0096698 A1* 4/2009 Semonov ..... H01Q 1/246 343/795
2010/0033393 A1* 2/2010 Myszne ..... H01Q 9/285 343/793
2010/0117916 A1* 5/2010 Gustafsson ..... H01Q 9/045 343/839
2011/0193761 A1* 8/2011 Shinkai ..... H01Q 9/16 343/817
2013/0169503 A1* 7/2013 Fakharzadeh Jahromi ..... H01Q 19/005 343/833
2016/0013545 A1* 1/2016 Hashimoto ..... H01Q 1/3283 343/713
2019/0118887 A1* 4/2019 Kinuhata ..... B62J 99/00
2020/0144710 A1* 5/2020 Ndip ..... H01Q 5/392
2020/0203848 A1* 6/2020 Tarng ..... H01Q 9/30

OTHER PUBLICATIONS

Imran Zohaib et al "Beam-switching planar parasitic antenna array" , 2014 Loughborough Antennas and Propagation Conference (LAPC),IEEE, Nov. 10, 2014 (Nov. 10, 2014), pp. 160-164, Fig1, Fig2, Fig9.
Kazushi Nishizawa et al "Broad Beamwidth and Cross Polarization Free Dipole Antennas With Reactive Loaded Monopoles",IEEE Transactions on Antennas and Propagation, IEEE Servis Center, Piscataway, NJ USvol. 55, No. 5, May 15, 2007(May 15, 2007), pp. 1230-1238, Fig1, Fig6.
Mitsuhiko Migaki, et al. " Study on an EPIRB Antenna for a 1. 6 GHz Band Satellite EPIRB System". Electronic Navigation Research Institute Papers No. 46, Aug. 1984, pp. 13-26.

* cited by examiner

DIRECTIONAL ANTENNA

CROSS-REFERENCE TO RELATED APPLICATIONS

This application claims the benefit of the earlier filing date of Japanese Patent Application No. 2018-009364, filed on Jan. 24, 2018. The entire contents of each of the identified applications are incorporated herein by reference.

BACKGROUND

Technical Field

The present teaching relates to a directional antenna.

Background Art

An example of a known directional antenna is a patch antenna. Another example of a known directional antenna is a microstrip antenna formed of three radiating elements shown in a Non-Patent Literature 1.

Non-Patent Literature 1: Misao HANEISHI, Kazuhiro HIRASAWA, Yasuo SUZUKI, "Small Planar Antenna", The Institute of Electronics, Information and Communication Engineers, August 1996, p. 177-181

SUMMARY

Technical Problem

A patch antenna is unlikely to be influenced by a metal or a human rearward of the antenna because the antenna does not radiate electric waves rearward of the antenna. The microstrip antenna of Non-Patent Literature 1 controls directivity in the direction forward of the antenna to some degree, because paired patch antennas are provided to oppose each other across a power supply antenna.

However, when such a directional antenna is used in, for example, a mobile communication environment, the intensity of electric waves radiated laterally from the antenna is insufficient. It has therefore been demanded for a directional antenna to have directivity covering a wide range in, for example, a mobile communication environment, by adjusting the directivity range.

To put it differently, a directional antenna having directivity covering a wide range by adjustment of the directivity range has been demanded.

An object of the present teaching is to provide a directional antenna having directivity covering a wide range by adjustment of a directivity range.

Solution to Problem

[1] A directional antenna of the present teaching is arranged such that a 3 dB beam width which is a communication available range of electromagnetic waves is equal to or greater than 180 degrees.

According to this arrangement, the 3 dB beam width which is the communication available range of electromagnetic waves is equal to or greater than 180 degrees. Therefore the electric waves of the directional antenna of the present teaching can be radiated in a wide range including forward and lateral directions from the directional antenna. Even if a metal or a person exists behind the directional antenna of the present teaching, an influence on the radiation characteristics is avoided in the directional antenna by adjusting the directivity range. Metal shields electric waves and decreases the intensity of the electric waves. Furthermore, metal reflects electric waves and decreases the intensity of electric waves on account of electric wave interference. Meanwhile, a human absorbs electric waves and decreases the intensity of the electric waves. The directional antenna of the present teaching therefore has directivity covering a wide range by adjustment of the range of directivity.

[2] According to another aspect of the present teaching, the directional antenna of the present teaching preferably has the following arrangement.

The directional antenna includes: a substrate; a power-supply radiating element on a front surface of the substrate; and paired non-power-supply radiating elements on the front surface of the substrate, wherein a 3 dB beam width of the directional antenna, which is a communication available range of electromagnetic waves, is equal to or greater than 180 degrees.

[3] According to another aspect of the present teaching, the directional antenna of the present teaching preferably has the following arrangement.

The directional antenna includes: the substrate which is arranged such that a front surface and a rear surface extend along a vertical direction which is orthogonal to a horizontal plane, such that a direction from the rear surface of the substrate toward the front surface of the substrate is a forward direction and a direction from the front surface of the substrate to the rear surface of the substrate is a rearward direction on the horizontal plane, the power-supply radiating element is provided on the front surface of the substrate to extend along the vertical direction and the power-supply radiating element receives electric power; paired non-power-supply radiating elements extend along the vertical direction, oppose each other across the power-supply radiating element in a horizontal direction which is a direction along the front surface of the substrate on the horizontal plane, when viewed in a front-rear direction which is orthogonal to the horizontal direction and the vertical direction, and do not receive the electric power, wherein the directional antenna further comprises and a metal plate which is provided on the rear surface of the substrate, at least a part of the metal plate being provided behind at least a part of the power-supply radiating element and the metal plate being not provided behind the non-power-supply radiating elements, wherein the 3 dB beam width on the horizontal plane is equal to or greater than 180 degrees including a range forward of the directional antenna.

According to this arrangement, the substrate is arranged such that the front surface and the rear surface extend along the vertical direction which is orthogonal to the horizontal plane. Electric power is supplied to the power-supply radiating element on the front surface of the substrate, whereas no electric power is supplied to the paired non-power-supply radiating elements which oppose each other across the power-supply radiating element in a horizontal direction which is a direction along the front surface of the substrate on the horizontal plane, when viewed in a front-rear direction which is orthogonal to the horizontal direction and the vertical direction. The power-supply radiating element is excited in response to power supply. The paired non-power-supply radiating elements are excited on account of an influence of the excitation of the power-supply radiating element. In this way, the power-supply radiating element and the paired non-power-supply radiating elements function as antennas. The directional antenna of the present teaching is able to prevent the occurrence of power supply loss. When a direction from the rear surface of the substrate toward the front surface of the substrate is a forward direction and a direction from the front surface of the substrate to the rear surface of the substrate is a rearward direction, the metal plate is provided behind at least a part of the power-supply radiating element. This prevents electric waves from the power-supply radiating element from being radiated rearward from that part of the power-supply radiating element. To put it differently, the electric waves from the power-supply radiating element are radiated in the forward direction and the lateral directions from the power-supply radiating element. The directional antenna of the present teaching is able to prevent unnecessary radiation of electric waves from the power-supply radiating element, and to obtain forward and lateral directivities from the power-supply radiating element. The metal plate is not provided behind the paired non-power-supply radiating elements. The paired non-power-supply radiating elements are therefore able to radiate electric waves in wide angles on the horizontal plane. In other words, with the directional antenna of the present teaching, the intensities of electric waves are sufficient in the lateral directions of the directional antenna. In the directional antenna of the present teaching, the 3 dB beam width which is the communication available range of electromagnetic waves is equal to or greater than 180 degrees on the horizontal plane. Even if a metal or a person exists behind the directional antenna of the present teaching, an influence on the radiation characteristics is avoided in the directional antenna by adjusting the directivity range. The directional antenna of the present teaching therefore has directivity covering a wide range by adjustment of the range of directivity. In the present teaching, lateral directions from the power-supply radiating element are equivalent to directions away from the power-supply radiating element in the horizontal direction. In the present teaching, lateral directions from the directional antenna are equivalent to directions away from the directional antenna in the horizontal direction.

[3] According to another aspect of the present teaching, the directional antenna of the present teaching preferably has the following arrangement.

The paired non-power-supply radiating elements are provided on the front surface of the substrate.

According to this arrangement, the power-supply radiating element and the paired non-power-supply radiating elements are provided on the front surface of the same substrate. For this reason, the directional antenna can be formed as a single printed board, for example. The directional antenna can therefore be easily formed.

[4] According to another aspect of the present teaching, the directional antenna of the present teaching preferably has the following arrangement.

The power-supply radiating element is a patch antenna, and the paired non-power-supply radiating elements are dipole antennas, respectively.

According to this arrangement, the power-supply radiating element is a patch antenna which is suitable as an antenna with directional characteristics. Meanwhile, the paired non-power-supply radiating element are dipole antennas suitable as an antenna with non-directional characteristics. This arrangement makes it possible to further secure forward and lateral directivities of the directional antenna. The directional antenna of the present teaching therefore has directivity covering a wide range by adjustment of the range of directivity.

[5] According to another aspect of the present teaching, the directional antenna of the present teaching preferably has the following arrangement.

The above-described directional antenna is mounted on a straddled vehicle.

According to this arrangement, the directional antenna is mounted on the straddled vehicle. Many of the components of the straddled vehicle are made of metal. Furthermore, an occupant who is a human is seated on the straddled vehicle. For example, when the directional antenna is mounted on the front surface of the vehicle body cover of the straddled vehicle, interference with a metal or absorption by an occupant, which are behind the directional antenna, can be prevented. This arrangement makes it possible to secure wide directivities of the directional antenna.

<Definition of 3 dB Beam Width>

In the present teaching, the 3 dB beam width is a communication available range of electromagnetic waves. To be more specific, in the present teaching, the 3 dB beam width indicates a range between two angles at each of which the intensity of the electromagnetic wave radiated from the antenna is smaller by 3 dB than the highest intensity, the range including an angle at which the intensity is highest.

<Definition of Straddled Vehicle>

In the present teaching, a straddled vehicle indicates all types of vehicles on which an occupant rides in a manner of straddling a saddle. The straddled vehicle encompasses motorcycles (including scooters), tricycles, personal water crafts, snowmobiles, and the like.

Other Definitions

In the present teaching, an end portion of a member indicates a portion constituted by an end and its surroundings of the member.

In the present teaching, an expression "members A and B are provided side by side in an X direction" indicates the following state. When the members A and B are viewed in a direction orthogonal to the X direction, the members A and B are both provided on a linear line which is parallel to the X direction. In the present teaching, an expression "members A and B are provided side by side in an X direction when viewed in a Y direction" indicates the following state. When the members A and B are viewed in the Y direction, the members A and B are both provided on a linear line which is parallel to the X direction. In this regard, when the members A and B are viewed in a W direction which is different from the Y direction, at least one of the members A and B may not be provided on the linear line which is parallel to the X direction. The members A and B may be in contact with each other. The members A and B may not be in contact with each other. A member C may be provided between the members A and B.

In this specification, an expression "a member A is provided forward of a member B" indicates the following state. The member A is provided in front of a plane which passes the front-most end of the member B and is orthogonal to the front-rear direction. In this connection, the members A and B may or may not be lined up in the front-rear direction. This applies to the directions other than the front-rear direction. (That is to say, this applies to the directions other than "forward of", such as "rearward of".)

In this specification, an expression "a member A is provided in front of a member B" indicates the following state. The members A and B are lined up in the front-rear direction and a part of the member A, the part facing the member B, is provided in front of the member B. According to this definition, when a part of the front surface of the member B, the part facing the member A, is the front-most end of the member B, the member A is provided forward of the member B. According to the definition, when a part of the front surface of the member B, the part facing the member A, is not the front-most end of the member B, the member A may or may not be provided forward of the member B. This applies to the directions other than the front-rear direction. (That is to say, this applies to the directions other than "in front of", such as "behind".) The front surface of the member B is a surface which is viewable when the member B is viewed from the front side. Depending on the shape of the member B, the front surface of the member B may be formed of plural surfaces, instead of a single continuous surface.

In this specification, an expression "a member A is provided in front of a member B when viewed in the left-right direction" indicates the following state. The members A and B are lined up in the front-rear direction when viewed in the left-right direction and a part of the member A, the part facing the member B, is provided in front of the member B when viewed in the left-right direction. According to this definition, the members A and B may not be lined up in the front-rear direction in three dimensions. This applies to the directions other than the front-rear direction. (That is to say, this applies to the directions other than "in front of", such as "behind".)

In the present teaching, the terms "including", "comprising", "having", and derivatives thereof are used to encompass not only listed items and equivalents thereof but also additional items. In the present teaching, the terms "mounted", "connected", "coupled", and "supported" are used in a broad sense. To be more specific, the terms encompass not only directly mounting, connection, coupling, and supporting but also indirect mounting, connection, coupling, and supporting. Furthermore, the terms "connected" and "coupled" are not limited to physical or mechanical connection and coupling. They indicate direct or indirect electrical connection or coupling.

Unless otherwise defined, all terms (technical and scientific terms) used in this specification indicate meanings typically understood by a person with ordinary skill in the art in the technical field to which the present teaching belongs.

Terms defined in typical dictionaries indicate meanings used in related technologies and in the context of the present disclosure. The terms are not interpreted ideally or excessively formally.

In this specification, the term "preferably" or "preferable" herein is non-exclusive. For example, the term "preferably" or "preferable" means "preferably/preferable, but not limited to." In this specification, the term "may" is non-exclusive. The term "may" indicate "may but not must".

When the number of a constituent feature is not clearly specified in claims and the constituent feature is expressed in a singular form, a plurality of the constituent features may be provided in the present teaching. Alternatively, in the present teaching, only one constituent feature may be provided.

In the present teaching, the above-described arrangements of different aspects may be combined. Before an embodiment of the present teaching is detailed, it is informed that the present teaching is not limited to the configurations and layout of elements described below and/or shown in drawings. The present teaching may be implemented as an embodiment other than the below-described embodiment. Furthermore, the present teaching may be implemented by suitably combining below-described modifications. Further, in the present teaching, modifications described below may be used in combination as needed.

Advantageous Effects

The directional antenna of the present teaching has directivity covering a wide range by adjustment of the range of directivity.

BRIEF DESCRIPTION OF THE DRAWINGS

FIG. 1A shows a front surface of a substrate, whereas FIG. 1B shows a rear surface of the substrate.

DESCRIPTION OF THE PREFERRED EMBODIMENTS

Figure 1A:
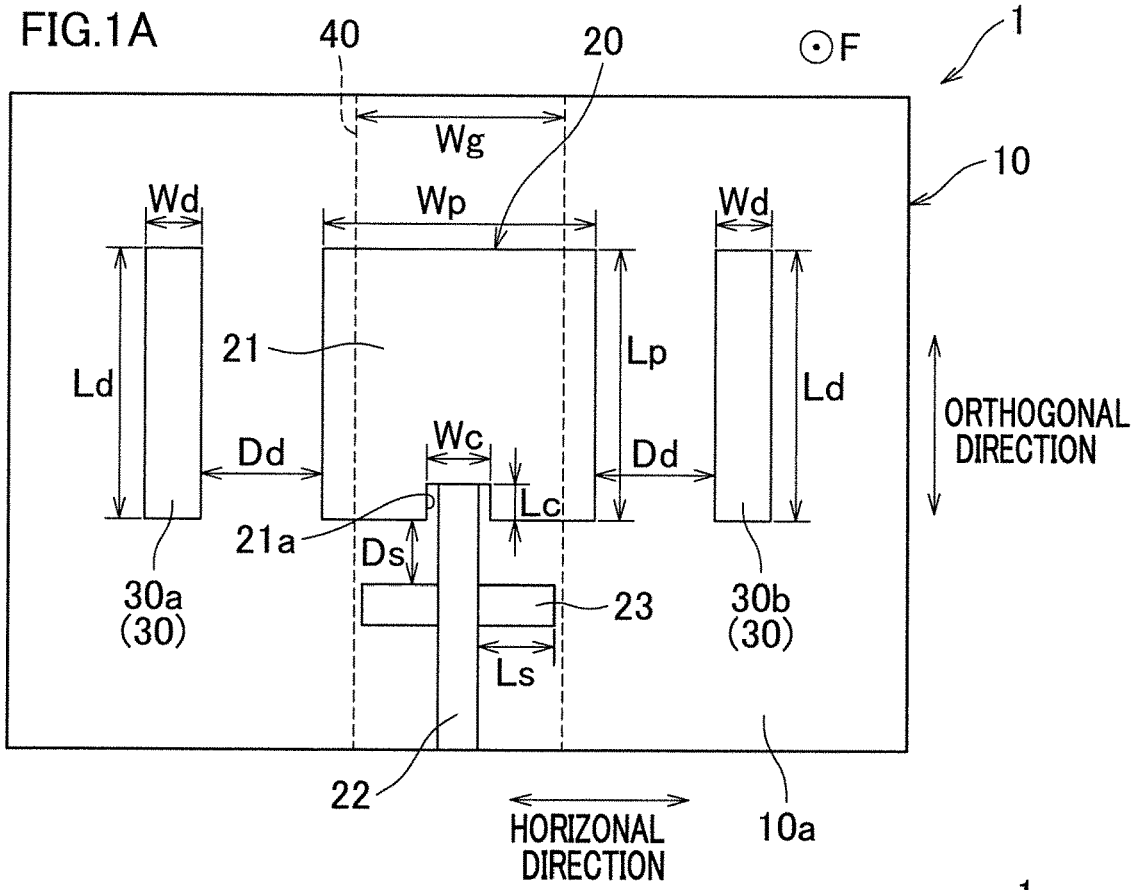
FIGS. 1A and 1B are schematic representations of a directional antenna of an embodiment.
Figure 1B:
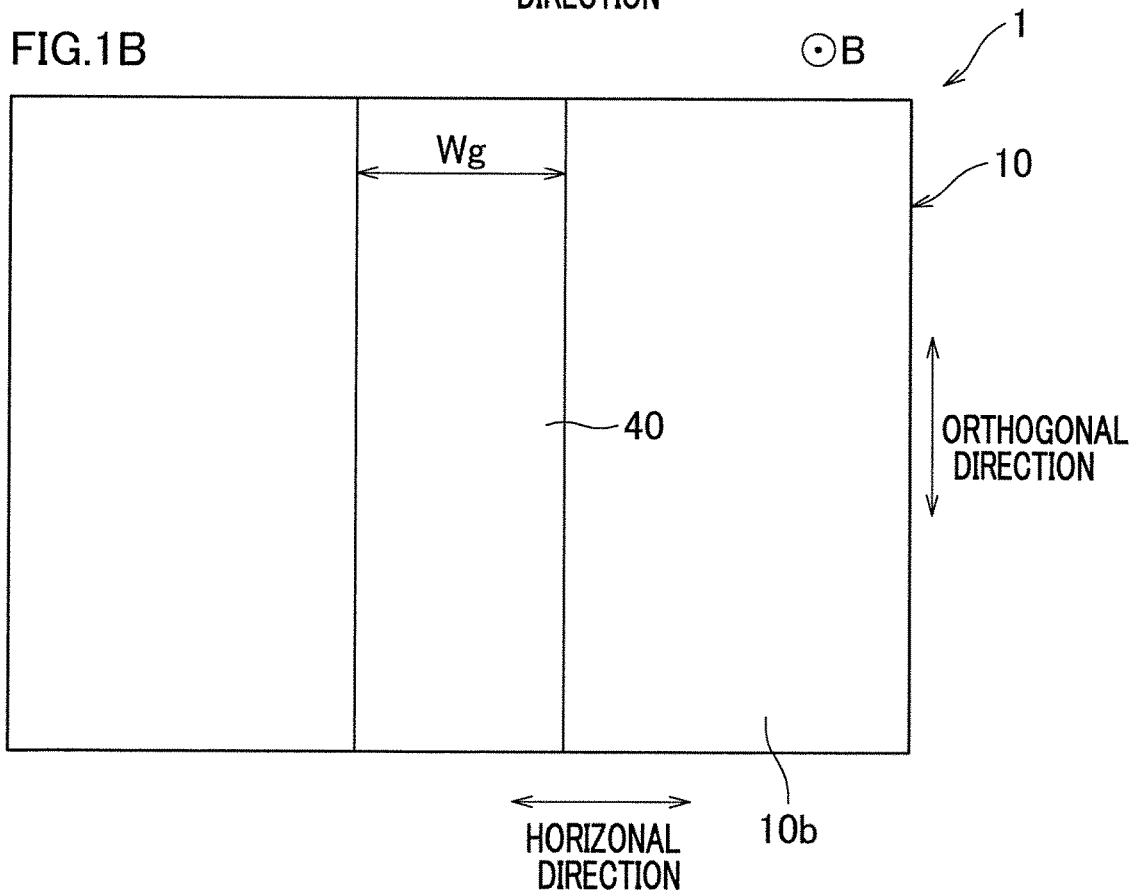

The following will describe a directional antenna 1 of an embodiment of the present teaching with reference to the schematic representation in FIGS. 1A and 1B. As shown in FIGS. 1A and 1B, the directional antenna 1 includes a substrate 10, a power-supply radiating element 20, paired non-power-supply radiating elements 30, and a metal plate 40.

The substrate 10 is a printed board formed to be flat in shape. The substrate 10 is made of a dielectric material having flexibility. The substrate 10 has a front surface 10*a* shown in FIG. 1A and a rear surface 10*b* shown in FIG. 1B. As shown in FIGS. 1A and 1B, the substrate 10 is arranged such that the front surface 10*a* and the rear surface 10*b* are along the vertical direction which is orthogonal to the horizontal plane. The vertical direction is indicated by arrows labeled "orthogonal direction" in FIGS. 1A and 1B. The horizontal plane is parallel to the horizontal direction which is along the front surface 10*a* of the substrate 10 indicated by the arrows labeled "horizontal direction" in FIGS. 1A and 1B, and when flat, the substrate 10 forms a plane that is parallel to the orthogonal direction and the horizontal direction. In FIGS. 1A and 1B, a direction from the rear surface 10*b* of the substrate 10 toward the front surface 10*a* that is orthogonal to the front surface 10*a* is a forward direction (indicated by F in the figures). Meanwhile, a direction from the front surface 10*a* of the substrate 10 toward the rear surface 10*b* that is orthogonal to the rear surface 10*b* is a rearward direction (indicated by B in the figures). The signs F and B in the figures indicate the forward and rearward directions, respectively.

As shown in FIG. 1A, the power-supply radiating element 20 is formed on the front surface 10*a* of the substrate 10. The power-supply radiating element 20 is a patch antenna. The power-supply radiating element 20 includes a patch portion 21, a power-supplying portion 22, and a stub portion 23. The patch portion 21 is formed to be a flat plate which is substantially square in shape, other than a cutout portion 21*a* to be described in further detail later. The maximum length Lp in the vertical direction of the patch portion 21 is substantially identical with the maximum width Wp in the horizontal direction. The term "substantially identical" means having a variation of five (5) percent or less, in the example shown in FIG. 1A. The patch portion 21 is provided with a cutout portion 21*a* at the center of one end portion in the vertical direction. The cutout portion 21*a* is rectangular in shape and has the length Lc in the vertical direction and the length We in the horizontal direction. The cutout portion 21*a* of the patch portion 21 is connected to the power-supplying portion 22, or in other words, the power-supplying portion 22 is connected to the patch portion 21 at the cutout portion 21*a*. The power-supplying portion 22 extends from the patch portion 21 to one end, in the vertical direction, of the front surface 10*a* of the substrate 10. The patch portion 21 receives electric power from the power-supplying portion 22. The stub portion 23 is provided to adjust the phase of the power-supply radiating element 20. The stub portion 23 is formed behind the power-supplying portion 22 (or, in other words, between the power-supplying portion 22 and the substrate 10) and extends along the horizontal direction. The stub portion 23 is formed such that the length Ls from the power-supplying portion 22 to one end in the horizontal direction is longer than the length of the stub portion 23 in the vertical direction. The stub portion 23 is separated from one end portion, or edge, of the patch portion 21 by the distance Ds in the vertical direction.

The paired non-power-supply radiating elements 30 are constituted by a non-power-supply radiating element 30*a* and a non-power-supply radiating element 30*b*. The non-power-supply radiating element 30*a* and the non-power-supply radiating element 30*b* are identical in shape. Each of the non-power-supply radiating element 30*a* and the non-power-supply radiating element 30*b* is rectangular in shape and has the length Ld in the vertical direction and the length Wd in the horizontal direction. Each of the non-power-supply radiating element 30*a* and the non-power-supply radiating element 30*b* is arranged so that the length Ld in the vertical direction is longer than the length Wd in the horizontal direction. The paired non-power-supply radiating elements 30 are dipole antennas. The paired non-power-supply radiating elements 30 are formed on the front surface 10*a* of the substrate 10 and extend along the vertical direction. In other words, the paired non-power-supply radiating elements 30 are provided on the front surface 10*a* of the substrate 10 to be parallel to the power-supply radiating element 20. The non-power-supply radiating element 30*a* and the non-power-supply radiating element 30*b* are provided on the front surface 10*a* of the substrate 10 to be parallel to each other. The paired non-power-supply radiating elements 30 oppose each other across the power-supply radiating element 20 in the horizontal direction when viewed in the front-rear direction which is orthogonal to the horizontal direction and the vertical direction. Each of the non-power-supply radiating element 30*a* and the non-power-supply radiating element 30*b* is separated from the power-supply radiating element 20 by the distance Dd in the horizontal direction. No power is supplied to the paired non-power-supply radiating elements 30.

As shown in FIG. 1B, the metal plate 40 is provided on apart of the rear surface 10*b* of the substrate 10. The metal plate 40 is formed to be a flat plate. The metal plate 40 is provided at the center in the horizontal direction of the rear surface 10*b* of the substrate 10 to have the length Wg in the horizontal direction. The metal plate 40 is formed to extend from first end portion to second end portion in the horizontal direction of the rear surface 10*b* of the substrate 10. The metal plate 40 is made of metal which reflects electromagnetic waves. As shown in FIG. 1A, the length Wg of the metal plate 40 in the horizontal direction is arranged to be shorter than the maximum length Wp in the horizontal direction of the patch portion 21 of the power-supply radiating element 20. This arrangement allows electromagnetic waves excited by the power-supply radiating element 20 to be radiated laterally from the substrate 10. In this specification, lateral directions from the power-supply radiating element 20 are equivalent to directions away from the power-supply radiating element 20 in the horizontal direction. A part of the metal plate 40 is provided behind a part of the power-supply radiating element 20. The metal plate 40 is not provided behind the paired non-power-supply radiating elements 30.

The resonance frequency of the directional antenna 1 is determined by the maximum length Lp in the vertical direction of the patch portion 21 of the power-supply radiating element 20 and the length Ld in the vertical direction of each of the paired non-power-supply radiating elements 30 (i.e., the non-power-supply radiating element 30*a* and the non-power-supply radiating element 30*b*). The input impedance of the directional antenna 1 is determined by the length Lc in the vertical direction of the cutout portion 21*a* of the power-supply radiating element 20, the length Wc in the horizontal direction of the cutout portion 21*a* of the power-supply radiating element 20, the length Ls in the horizontal direction of the stub portion 23, and the distance Ds in the vertical direction between the stub portion 23 and the patch portion 21. The horizontal plane directivities of the directional antenna 1 are determined by the distance Dd in the horizontal direction between the power-supply radiating element 20 and each of the paired non-power-supply radiating elements 30, the length Wd in the horizontal direction of each of the paired non-power-supply radiating elements 30, and the length Wg in the horizontal direction of the metal plate 40. It is therefore possible to adjust the directivity range of the directional antenna 1 by adjusting these design parameters described above. For example, the resonance frequency is changed when the length of each of the paired non-power-supply radiating elements 30 in the vertical direction is changed relative to the power-supply radiating element 20. The design parameters Lp, Lc, Wc, Dd, Wd, Wg, Ld, Ls, and Ds can be determined by a multi-objective genetic algorithm which gives a Pareto solution.

Figure 2:
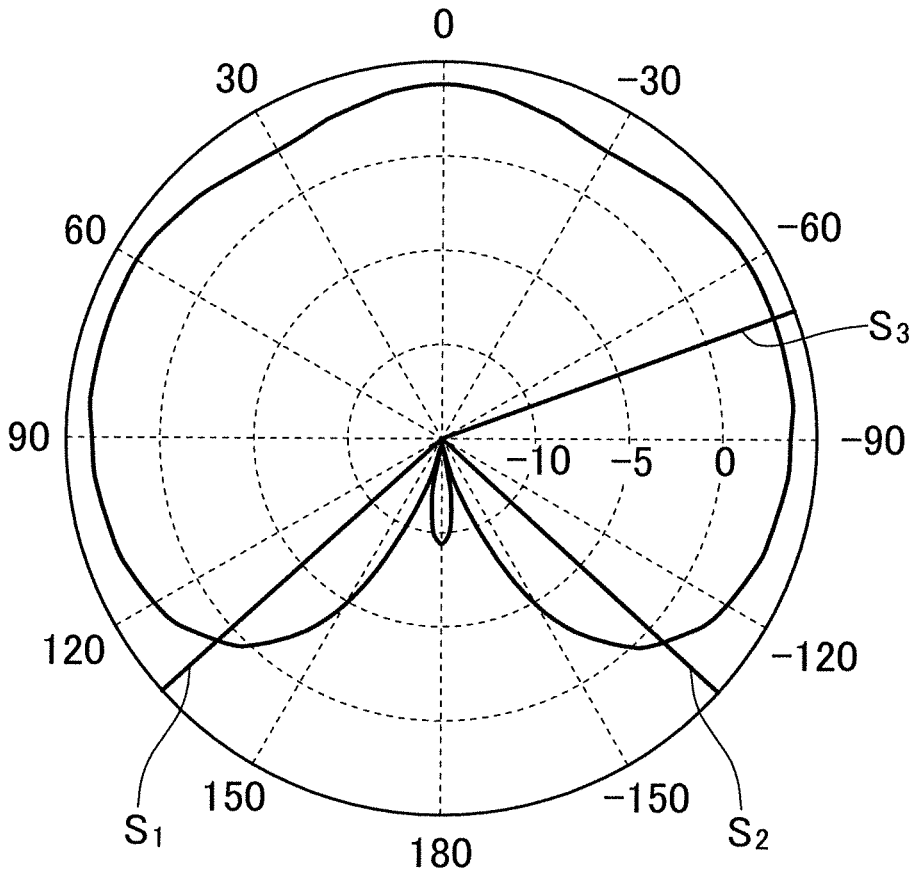
FIG. 2 shows an example of a simulation result of horizontal plane directivities of the directional antenna of the embodiment.
Figure 3:
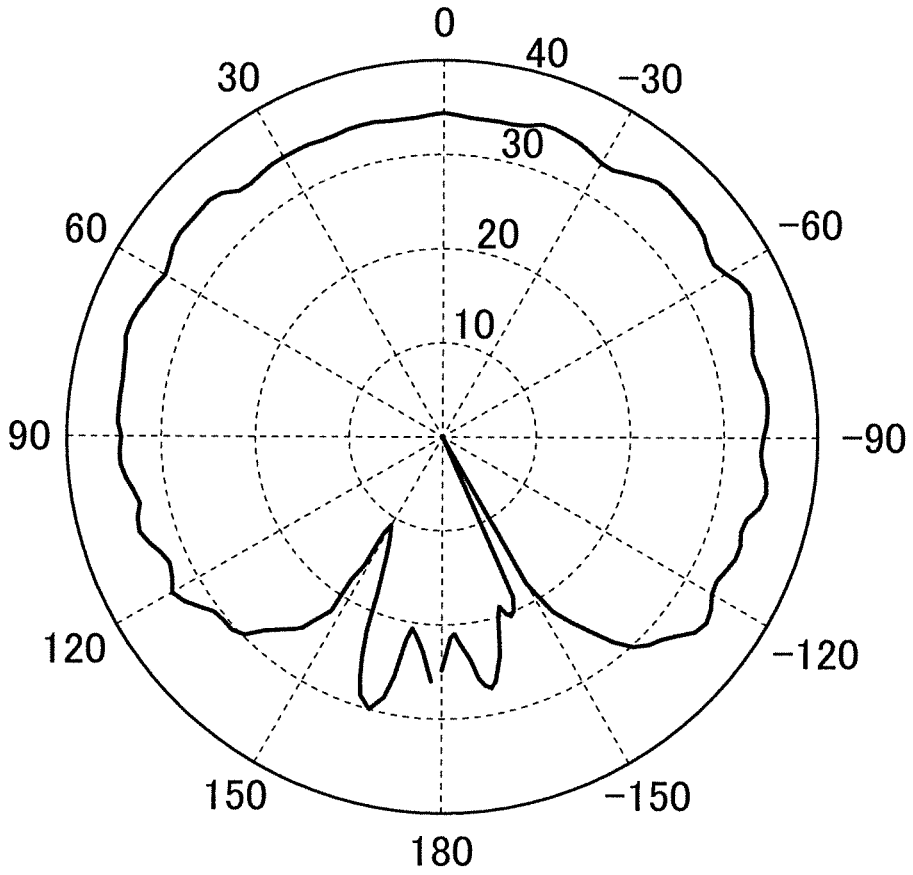
FIG. 3 shows an example of a measurement result of horizontal plane directivities of the directional antenna of the embodiment.

An example of a simulation result of the horizontal plane directivities of the directional antenna 1 is shown in FIG. 2. Furthermore, an example of a result of the horizontal plane directivities of an experimentally-manufactured directional antenna 1 is shown in FIG. 3. FIG. 2 and FIG. 3 show the intensities of electromagnetic waves on the horizontal plane of the directional antenna 1. The directional antenna 1 is provided at the center of each of FIG. 2 and FIG. 3, and the horizontal axis (±90°) in each figure indicates the horizontal direction of the directional antenna 1. The forward direction of the directional antenna 1 is a direction toward 0° from the center, and the rearward direction of the directional antenna 1 is a direction toward 180° from the center in FIG. 2 and FIG. 3. The lateral directions of the directional antenna 1 are directions toward ±90° from the center in FIG. 2 and FIG. 3. In this specification, the lateral directions of the directional antenna 1 are equivalent to directions away from the directional antenna 1 in the horizontal direction. A range forward of the directional antenna 1 is a range between −90° and 90° including 0° in FIG. 2 and FIG. 3.

In the simulation shown in FIG. 2, the relative permittivity of the substrate 10 was 2.16, the dielectric loss of the substrate 10 was 0.0005, the thickness of the substrate 10 was 0.8 mm, and the operating frequency of the substrate 10 was 5.9 GHz. This substrate 10 was mounted along a cylindrical curved surface with the relative permittivity of 3.0, thickness of 2.5 mm, and radius of 12.5 cm, and the design parameters were optimized. The design parameters after the optimization were Lp=17.6 mm, Lc=3.5 mm, Wc=5.5 mm, Dd=9.0 mm, Wd=5.0 mm, Wg=13.0 mm, Ld=13.6 mm, Ls=4.2 mm, and Ds=3.0 mm. An objective function in the simulation was executed as maximization of the minimum gain in the coverage, minimization of the difference between the maximum gain and the minimum gain in the coverage, and minimization of a back lobe level (a rearward radiation level of the directional antenna 1).

As the simulation result in FIG. 2 shows, the 3 dB beam width which is the communication available range of electromagnetic waves on the horizontal plane of the directional antenna 1 falls within the range between angles S1 and S2 in the figure (i.e., from about −135° to about 135°). In other words, the 3 dB beam width of the directional antenna 1 on the horizontal plane is equal to or greater than 180 degrees including the range forward of the directional antenna 1. S3 in the figure indicates an angle at which the intensity of the electromagnetic waves is the highest. The simulation result in FIG. 3 shows that the back lobe is restrained while the lateral radiations are sufficient in the directional antenna 1.

The experimentally-manufactured directional antenna 1 shown in FIG. 3 uses the same design parameters as the directional antenna 1 used in the simulation shown in FIG. 2. As the measurement result in FIG. 3 shows, the 3 dB beam width which is the communication available range of electromagnetic waves on the horizontal plane of the directional antenna 1 is equal to or greater than 180 degrees including the range forward of the directional antenna 1. It is noted that the back lobe in the measurement result in FIG. 3 is large on account of a mounting jig to which the directional antenna 1 is attached.

Because of the arrangement above, the directional antenna 1 of the present embodiment exerts the following effects.

The substrate 10 is arranged such that the front surface 10*a* and the rear surface 10*b* extend along the vertical direction which is orthogonal to the horizontal plane. Power is supplied to the power-supply radiating element 20 on the front surface 10*a* of the substrate 10 whereas no power is supplied to the paired non-power-supply radiating elements 30 opposing each other across the power-supply radiating element 20 in the horizontal direction. The power-supply radiating element 20 is excited in response to power supply. The paired non-power-supply radiating elements 30 are excited on account of an influence of the excitation of the power-supply radiating element 20. In this way, the power-supply radiating element 20 and the paired non-power-supply radiating elements 30 function as antennas. The directional antenna 1 of the present embodiment is able to prevent the occurrence of power supply loss.

The metal plate 40 is provided behind at least a part of the power-supply radiating element 20. This prevents electric waves from the power-supply radiating element 20 from being radiated rearward from that part of the power-supply radiating element 20. To put it differently, the electric waves from the power-supply radiating element 20 are radiated in the forward direction and the lateral directions from the power-supply radiating element 20. The directional antenna 1 of the present embodiment is able to prevent unnecessary radiation of electric waves from the power-supply radiating element 20, and to obtain forward and lateral directivities from the power-supply radiating element 20. The metal plate 40 is not provided behind the paired non-power-supply radiating elements 30. The paired non-power-supply radiating elements 30 are therefore able to radiate electric waves in wide angles on the horizontal plane. In other words, with the directional antenna 1 of the present teaching, the intensities of electric waves are sufficient in the lateral directions of the directional antenna 1. In the directional antenna 1 of the present embodiment, the 3 dB beam width which is the communication available range of electromagnetic waves is equal to or greater than 180 degrees on the horizontal plane. Even if a metal or a person exists behind the directional antenna 1 of the present embodiment, an influence on the radiation characteristics is avoided in the directional antenna 1 by adjusting the directivity range.

Furthermore, the power-supply radiating element 20 and the paired non-power-supply radiating elements 30 are provided on the surface of the same substrate 10. For this reason, the directional antenna 1 can be formed as a single printed board, for example. The directional antenna 1 can therefore be easily formed.

Furthermore, the power-supply radiating element 20 is a patch antenna which is suitable as an antenna with directional characteristics. The paired non-power-supply radiating elements 30 are dipole antennas suitable as an antenna with non-directional characteristics. This arrangement makes it possible to further secure forward and lateral directivities of the directional antenna 1.

The directional antenna 1 of the present embodiment is therefore able to have directivity covering a wide range by adjustment of the range of directivity.

Preferred embodiments of the present teaching have been described above. However, the present teaching is not limited to the above-described embodiments, and various changes can be made within the scope of the claims. Further, modifications described below may be used in combination as needed.

The directional antenna of the present teaching may be variously arranged on condition that, in regard to the horizontal plane directivities, the 3 dB beam width is equal to or greater than 180 degrees including the range forward of the directional antenna.

The substrate 10 of the embodiment above is made of a dielectric material having flexibility. Alternatively, the substrate of the present teaching may be made of a dielectric material not having flexibility. The substrate 10 of the embodiment above is formed to be a flat plate. Alternatively, the substrate of the present teaching may be a plate with a curved surface. In other words, the directional antenna of the present teaching may be, for example, mounted on a substrate formed of a dielectric having a curved surface.

The length Wg of the metal plate 40 of the embodiment above in the horizontal direction is arranged to be shorter than the maximum length Wp in the horizontal direction of the patch portion 21 of the power-supply radiating element 20. Alternatively, the directional antenna of the present teaching may be arranged such that the length in the horizontal direction of the metal plate is identical with the length in the horizontal direction of the power-supply radiating element. Alternatively, the directional antenna of the present teaching may be arranged such that the length in the horizontal direction of the metal plate maybe longer than the length in the horizontal direction of the power-supply radiating element.

The paired non-power-supply radiating elements 30 of the directional antenna 1 of the embodiment above are constituted by the two non-power-supply radiating elements 30*a* and 30*b*. Alternatively, in the directional antenna of the present teaching, two or more paired non-power-supply radiating elements may be provided. For example, the directional antenna may include four non-power-supply radiating elements.

The directional antenna of the present teaching may be mounted on a straddled vehicle. The straddled vehicle is, for example, a motorcycle. The directional antenna of the present teaching can be provided at, for example, the front surface of the vehicle body cover of the straddled vehicle. The directional antenna of the present teaching is preferably provided at a position where a metal or a human does not oppose the front surface or a side surface of the power-supply radiating element. The directional antenna of the present teaching may be mounted on a vehicle which is not a straddled vehicle. The directional antenna of the present teaching may be used for vehicle-to-vehicle communication and road-to-vehicle communication.

REFERENCE SIGNS LIST

1 directional antenna
10 substrate
20 power-supply radiating element
30 non-power-supply radiating element
40 metal plate

What is claimed is:

1. A directional antenna comprising:

a substrate which is arranged such that a front surface and a rear surface extend along a vertical direction which is orthogonal to a horizontal plane, such that a direction from the rear surface of the substrate toward the front surface of the substrate is a forward direction and a direction from the front surface of the substrate to the rear surface of the substrate is a rearward direction on the horizontal plane, a power-supply radiating element which is provided on the front surface of the substrate to extend along the vertical direction and the power-supply radiating element receives electric power, at least paired non-power-supply radiating elements which extend along the vertical direction, oppose each other across the power-supply radiating element in a horizontal direction which is a direction along the front surface of the substrate on the horizontal plane when viewed in a front-rear direction which is orthogonal to the horizontal direction and the vertical direction, and do not receive the electric power, and a metal plate which is provided on the rear surface of the substrate, at least a part of the metal plate being provided behind at least a part of the power-supply radiating element and the metal plate being not provided behind the non-power-supply radiating elements, wherein a 3 dB beam width on the horizontal plane is equal to or greater than 180 degrees including a range forward of the directional antenna when the power-supply radiating element is excited in response to power supply and the at least paired non-power-supply radiating elements are excited on account of an influence of excitation of the power-supply radiating element.

2. The directional antenna according to claim 1, wherein the paired non-power-supply radiating elements are provided on the front surface of the substrate.

3. The directional antenna according to claim 1, wherein the power-supply radiating element is a patch antenna, and the paired non-power-supply radiating elements are dipole antennas, respectively.

4. The directional antenna according to claim 2, wherein the power-supply radiating element is a patch antenna, and the paired non-power-supply radiating elements are dipole antennas, respectively.

5. The directional antenna according to claim 1, the directional antenna being mounted on a straddled vehicle.

6. The directional antenna according to claim 2, the directional antenna being mounted on a straddled vehicle.

7. The directional antenna according to claim 3, the directional antenna being mounted on a straddled vehicle.

8. The directional antenna according to claim 4, the directional antenna being mounted on a straddled vehicle.

* * * * *